United States Patent [19]

Draghetti

[11] Patent Number: 5,003,755

[45] Date of Patent: Apr. 2, 1991

[54] METHOD AND DEVICE FOR PRODUCING TUBULAR WRAPPINGS

[75] Inventor: Fiorenzo Draghetti, Medicina, Italy

[73] Assignee: G.D Societa' Per Azioni, Bologna, Italy

[21] Appl. No.: 566,265

[22] Filed: Aug. 13, 1990

[30] Foreign Application Priority Data

Sep. 14, 1989 [IT] Italy ..... 3622 A/89

[51] Int. Cl.[5] ..... B65B 11/32

[52] U.S. Cl. ..... 53/466; 53/463; 53/233; 53/234

[58] Field of Search ..... 53/466, 225, 234, 233, 53/463

[56] References Cited

U.S. PATENT DOCUMENTS

| | | | |
|---|---|---|---|
| 264,380 | 9/1882 | Waters | 53/234 |
| 3,978,639 | 9/1926 | Ferrozzi | 53/234 X |
| 4,823,536 | 4/1989 | Manservigi | 53/234 X |

*Primary Examiner*—John Sipos

*Attorney, Agent, or Firm*—Marshall, O'Toole, Gerstein, Murray & Bicknell

[57] ABSTRACT

A method and device for producing tubular wrappings for products of parallelepiped shape or similar; whereby the products are fed successively, and in a substantially radial direction, to a wrapping wheel turning at substantially constant speed and having a number of mobile elements, each defining a seat for a respective product. Each product is inserted inside a respective seat together with a sheet of wrapping material, which is folded in a U and presents two opposite portions projecting outwards of the seat. One of the portions is folded down on to the product by a first folding element, and the mobile element is moved on the wheel so as to fold and hold down the other portion by means of a second folding element mounted on the wheel, and so as to move the seat into a position facing a joining device for firmly joining the two folded opposite portions of the sheet of wrapping material.

10 Claims, 5 Drawing Sheets

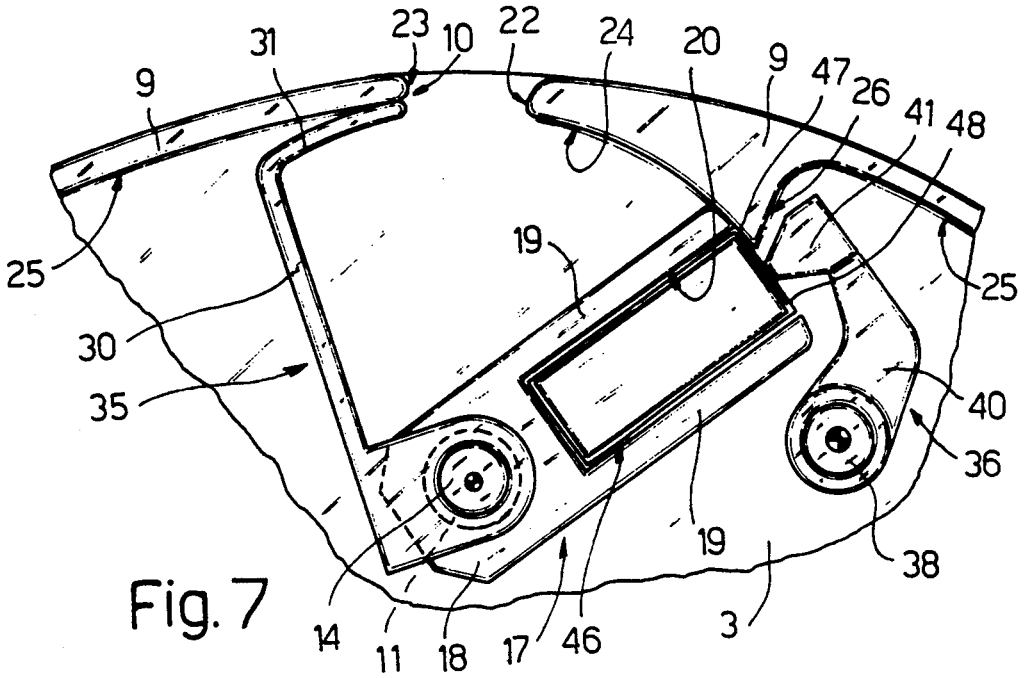
Fig. 7
Fig. 8
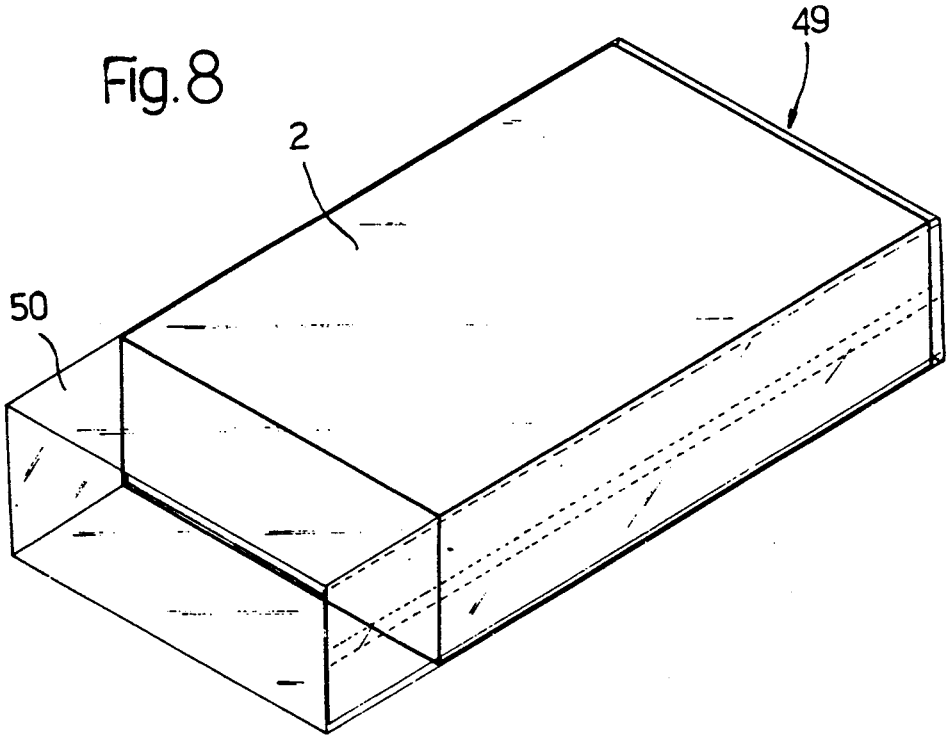

METHOD AND DEVICE FOR PRODUCING TUBULAR WRAPPINGS

BACKGROUND OF THE INVENTION

The present invention relates to a method of producing tubular wrappings preferably, but not necessarily, of parallelepiped shape or similar.

In particular, the present invention relates to a method which may be used to advantage on cigarette packing machines, for producing the tubular outer wrapping or transparent tubular wrapping of so-called soft packs.

On known packing machines, tubular wrappings of the aforementioned type are normally produced by successively feeding sheets of wrapping material over respective peripheral openings formed about a wrapping wheel and each defining the access to a respective radial seat on the same. The wheel is jogged about its axis so as to successively feed said seats to a loading station where each seat is arrested long enough to receive the product for wrapping. Insertion of the product inside the seat is usually accompanied by simultaneous insertion of the sheet of wrapping material over the opening, which is gradually folded in a U about the product as this enters the seat. The sheet of wrapping material is usually of such a length that, when the product is fully inserted inside the seat, the opposite end portions of the sheet project outwards of the same.

The loading station usually presents a first folding device which, subsequent to insertion of the product and prior to rotation of the wrapping wheel, is activated for folding down on to the product a first of said end portions, usually the one located upstream in relation to the traveling direction of the seat. The wheel is then jogged forward one step to bring the next seat into the loading station and feed the previous seat beneath a fixed outer plate designed to engage the second of said end portions and fold it back on to the product so that it at least partially overlaps the first portion. For one or more successive steps of the wrapping wheel, the product, with the end portions of the sheet folded as described above, slides beneath the fixed outer plate, which provides for holding down the folded end portions one on top of the other.

The above situation continues until the product is arrested by the wrapping wheel at a joining station, at which point the fixed plate terminates and the product is arrested in such a position as to project partially from the end of the plate, but with a sufficient portion still engaged by the same for holding the end portions of the sheet folded down one on top of the other. At this point, an external joining device, e.g. a gumming or welding device at the station, acts on the part of the two end portions projecting from the fixed plate, so as to join the end portions together and so form the tubular wrapping.

The above known method therefore requires the use of a jog feed device, n this case, a jog type wrapping wheel, for at least enabling operation of the joining device.

SUMMARY OF THE INVENTION

The aim of the present invention is to provide a method of producing tubular wrappings, enabling the elimination of a jog type product feed device and, consequently, the speed restrictions and relatively high noise levels typically associated with such devices.

With this aim view, according to the present invention, there is provided a method of producing tubular wrappings for products of preferably parallelepiped shape or similar; said method comprising stages consisting in successively feeding sheets of wrapping material over respective peripheral openings formed on a wrapping wheel and enabling access to respective seats formed on said wheel; feeding said products successively, and in a substantially radial direction, through respective said openings and into respective said seats, insertion of each said product being accompanied by simultaneous insertion of the respective said sheet, which is folded in a U about said product inside said seat, with two opposite portions projecting outwards of said opening; successively folding said two portions about said product, so that a second of said portions at least partially overlaps a first of said portions; and stably connecting said two overlapping portions via joining means; characterised by the fact that said wheel is rotated at substantially constant speed about its axis, and each said seat is formed on a seat holder element mounted in mobile manner on said wheel and moved in relation to the same between a first position, wherein said seat faces substantially radially outwards of said wheel, and a second position wherein said seat is aligned with respective said joining means supported on said wheel; said second portion being folded by moving the respective said seat holder element into said second position, and via interference with folding means supported in a fixed position on said wheel.

According to the present invention, there is also provided a device for producing tubular wrappings for products of preferably parallelepiped shape or similar; said device comprising a rotary wrapping wheel having a number of peripheral seats and a number of peripheral openings, each enabling access to a respective said seat, which is designed to receive a respective said product together with a respective sheet of wrapping material folded in a U about said product with two opposite portions projecting outwards of said seat through said opening; folding means for successively folding said two portions about said product, so that a second of said portions at least partially overlaps a first of said portions; and joining means for stably connecting said two overlapping portions; characterised by the fact that, for each said seat, said device comprises a joining means supported on said wheel; a seat holder element assigned to said joining means and mounted in mobile manner on said wheel; and first activating means for moving each said seat holder element, in relation to said wheel, between a first position, wherein said seat faces substantially radially outwards of said wheel, and a second position wherein said seat is aligned with the respective said joining means; said wheel turning at substantially constant speed about its axis; and said folding means comprising, for each said seat holder element, a fixed folding means supported on said wheel in such a position as to interfere with the path of said second portion as the respective said seat holder element is moved into said second position.

BRIEF DESCRIPTION OF THE DRAWINGS

A non-limiting embodiment of the present invention will be described by way of example with reference to the accompanying drawings, in which:

FIGS. 3 to 7 show a detail in FIG. 1 in successive operating positions;

FIG. 8 shows a view in perspective of a wrapped product.

DETAILED DESCRIPTION OF THE INVENTION

Figure 1:
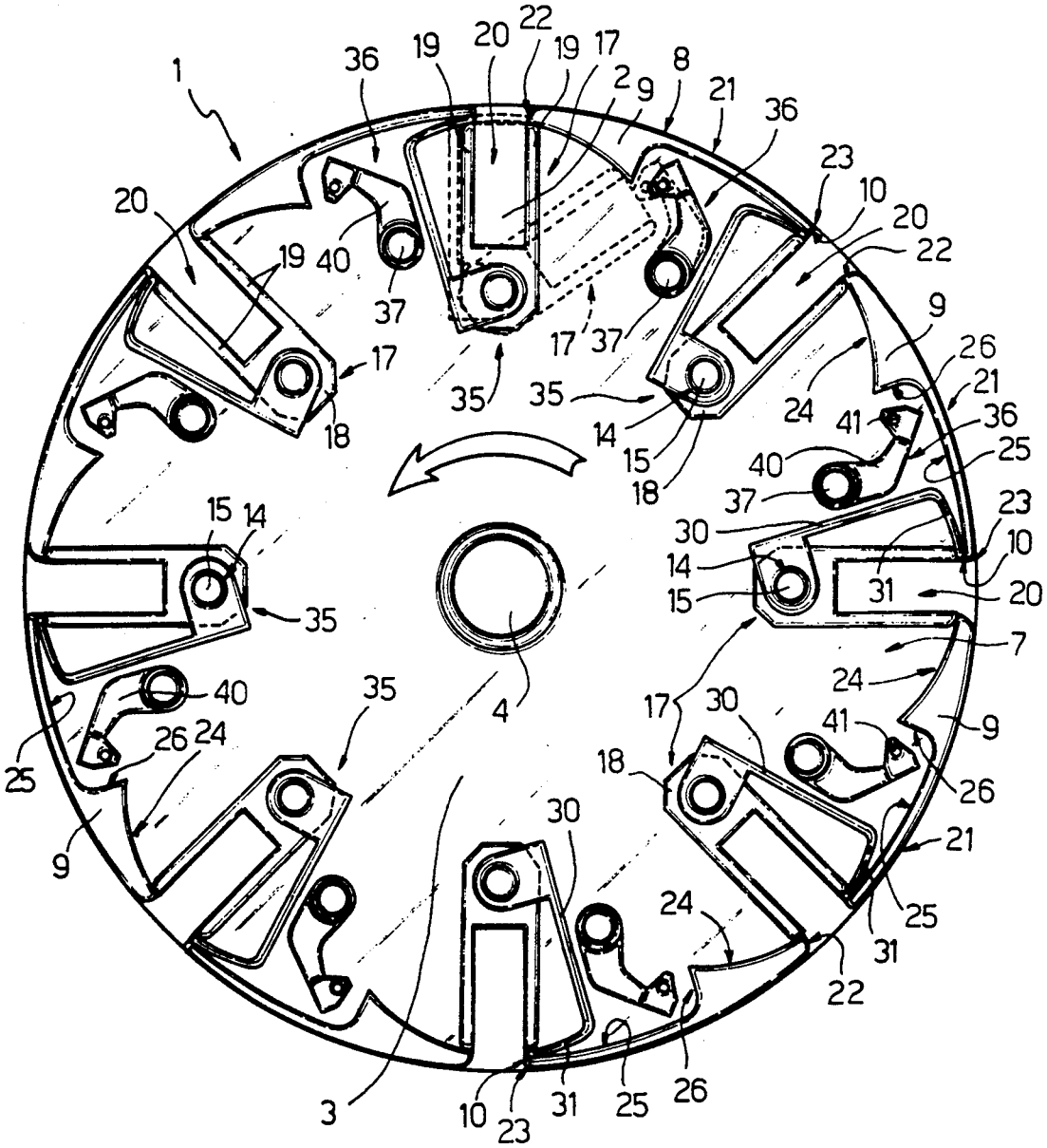
FIG. 1 shows a schematic front view of a preferred embodiment of a device in accordance with the present invention.
Figure 2:
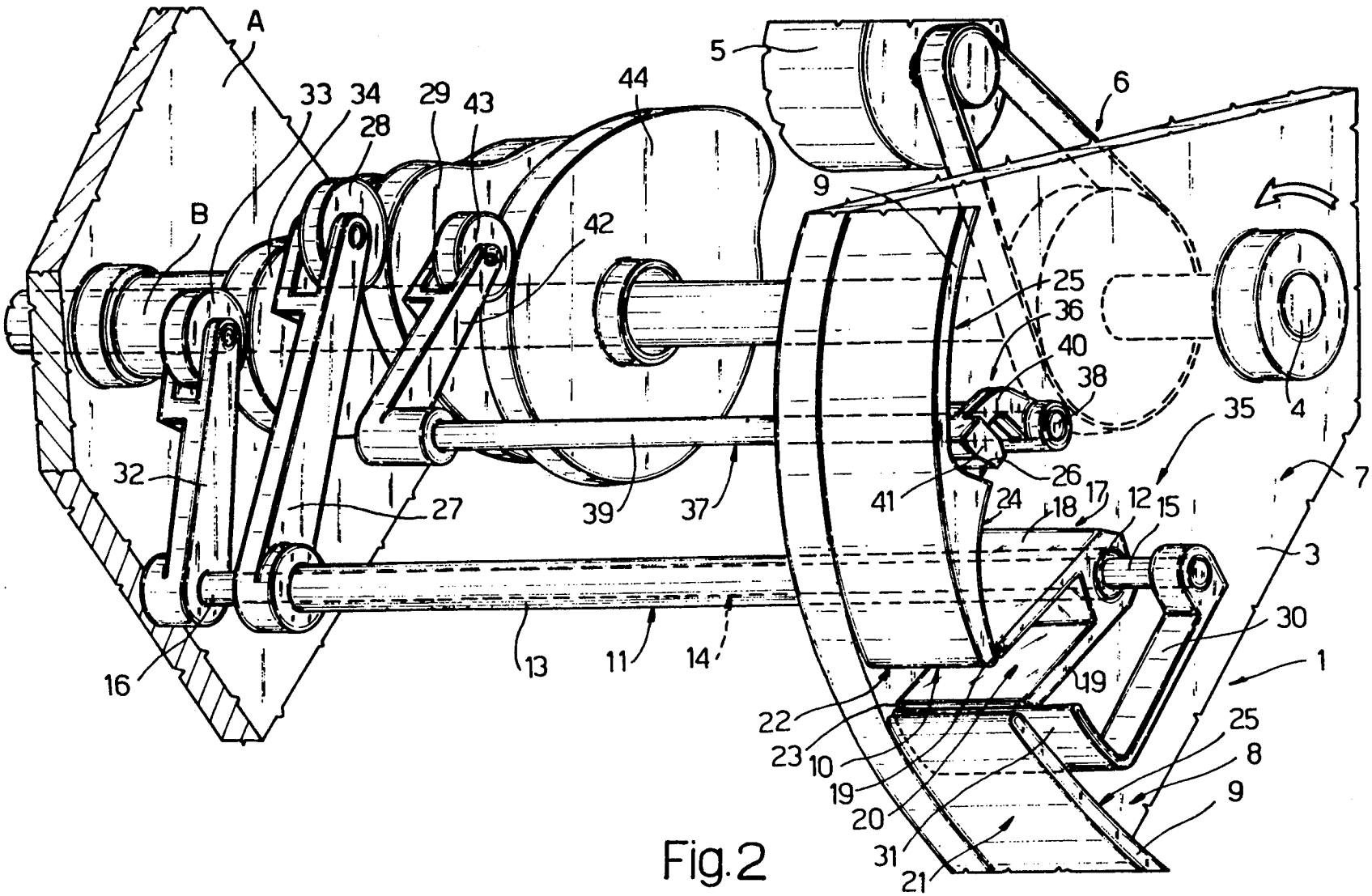
FIG. 2 shows a larger-scale view in perspective of the FIG. 1 device with parts removed for simplicity.

Number 1 in FIGS. 1 and 2 indicates the wrapping wheel of a packing machine, in particular, a cellophaning machine, for products 2 (only one of which is shown in FIG. 1) shaped in the form of a rectangular parallelepipedon and consisting, in the example shown, of packets of cigarettes.

Wheel 1 comprises a disc 3 fitted on to a central horizontal shaft 4 extending rearwards of disc 3 as shown in FIG. 2. Shaft 4 is supported on a fixed wall A of the packing machine, and is turned about its axis at substantially constant speed (and anticlockwise in FIG. 1) by a motor 5 connected to shaft 4 by drive 6.

From the outer edge of a flat circular front surface 7 of disc 3, there extends axially a substantially cylindrical wall or shell 8 divided into a number of segments 9 by a number of substantially rectangular slots or openings 10 equally spaced about the edge of circular surface 7. As shown more clearly in FIG. 2, disc 3 is fitted through with a number of tubular shafts 11 equally spaced about a circumference coaxial with shaft 4 and of the same number as openings 10. Each shaft 11 is arranged with its axis lying in a plane through the axis of shaft 4 and through the center line of a respective opening 10, and comprises a portion 12 projecting frontwards of surface 7 and substantially of the same height as shell 8, and a portion 13 projecting rearwards of disc 3. Each shaft 11 houses in rotary manner a further shaft 14 comprising a front portion 15 and a rear portion 16 projecting respectively from the front end of front portion 12 and the rear end of rear portion 13 of shaft 11.

Front portion 12 of each shaft 11 is fitted with a pocket element 17, hereinafter referred to as a "seat holder element", comprising a hub 18 fitted on to shaft 11, and two parallel arms 19 extending substantially radially outwards of hub 18 and defining, together with hub 18, a seat 20 open at its axial ends and the side opposite hub 18, and designed to fully house product 2. In particular, said side opening of each seat 20 is substantially of the same shape and size as openings 10. Segments 9 of shell 8 will now be described with reference to FIGS. 1 and 2, bearing in mind that the terms "front" and "rear" used in relation to each segment 9 refer to the rotation direction of wheel 1 (anticlockwise in FIG. 1).

Each segment 9 is defined externally by a curved cylindrical surface 21 coaxial with shaft 4 and extending between the front edge 22 and rear edge 23 of segment 9. On the side facing shaft 4, each segment 9 is defined by a first curved cylindrical surface 24 extending rearwards from front edge 22, and by a second curved surface 25 extending frontwards from rear edge 23 and joined to the rear end of curved surface 24 by a surface 26 substantially radial in relation to shaft 4. In particular, surface 25 is substantially coaxial with shaft 4, while surface 24 is coaxial with shafts 11 and 14 facing opening 10 to the front of front edge 22.

As shown in FIG. 2, from rear portion 13 of each shaft 11, there projects outwards an arm 27, to the free end of which is connected for rotation a lappet roller 28 designed to move in contact with a fixed cam 29 supported centrally and in a fixed position on a through coupling B integral with wall A and extending towards disc 2 coaxially with shaft 4. As described in more detail later on, fixed cam 29 is so designed that, for each complete turn of wheel 1 about its axis, each seat holder element 17 swings about the axis of shaft 11, so that the side opening of seat 20 moves, substantially contacting surface 24 of segment 9, between a first position, wherein it is aligned with a respective opening 10 defined rearwards by front edge 22 of segment 9, and a second position wherein it projects partially rearwards from the rear end of surface 24.

As shown in FIG. 2, an arm 30 projects radially from front portion 15 of each shaft 14, one end of which arm 30 is fitted on to portion 15, and the other end of which is fitted with a mobile folder 31 consisting of a flat plate extending axially in relation to disc 3 and perpendicularly to arm 30, and designed to move inside shell 8 and past the side opening of seat 20. From rear portion 16 of each shaft 14, there projects outwards an arm 32, to the free end of which is connected for rotation a tappet roller 33 designed to move in contact with a fixed cam 34 supported centrally on coupling B. As described in more detail later on, fixed cam 34 is so designed that, for each complete turn of wheel 1 about its axis, each folder 31 swings about the axis of shaft 14 so as to move, substantially contacting surface 25 of segment 9, between a first idle position, wherein the rear edge of folder 31 is aligned with rear edge 23 of segment 9, and a second operating position wherein folder 31 substantially closes opening 10 defined frontwards by rear edge 23 of segment 9.

Together with mobile folder 31, seat holder element 17 and segment 9 immediately behind opening 10 facing shafts 11 and 14, each pair of coaxial shafts 11 and 14 defines a "wrapper forming" unit indicated as a whole by 35 and also comprising a joining device 36 comprising a further shaft 37 parallel to shafts 11 and 14 and mounted for rotation through disc 3, facing surface 25 of segment 9.

Shafts 37 (FIG. 1) are equally spaced about a circumference coaxial with shaft 4 and slightly larger in diameter than the circumference about which shafts 11 are spaced. Each shaft 37 (FIG. 2) comprises a front portion 38 projecting frontwards of disc 3 and of substantially the same length as front portion 12 of shafts 11; and a rear portion 39 projecting rearwards of disc 3. The free end of each portion 38 is fitted with one end of a substantially radial arm 40, the free end of which is connected to a joining element extending towards and axially in relation to disc 3, and consisting, in the embodiment shown, of a welder 41.

From portion 39 of each shaft 37 (FIG. 2) there extends outwards an arm 42, lo the free end of which is connected for rotation a tappet roller 43 designed to move in contact with a fixed cam 44 supported centrally on coupling B. As described in more detail later on, fixed cam 44 is so designed that, for each complete turn of wheel 1 about its axis, each welder 41 swings about the axis of shaft 37 so as to move, behind surface 25 of segment 9 on unit 35, to and from an operating position wherein it is tangent to the center line of the side opening of seat holder element 17 in said second position.

Figure 3:
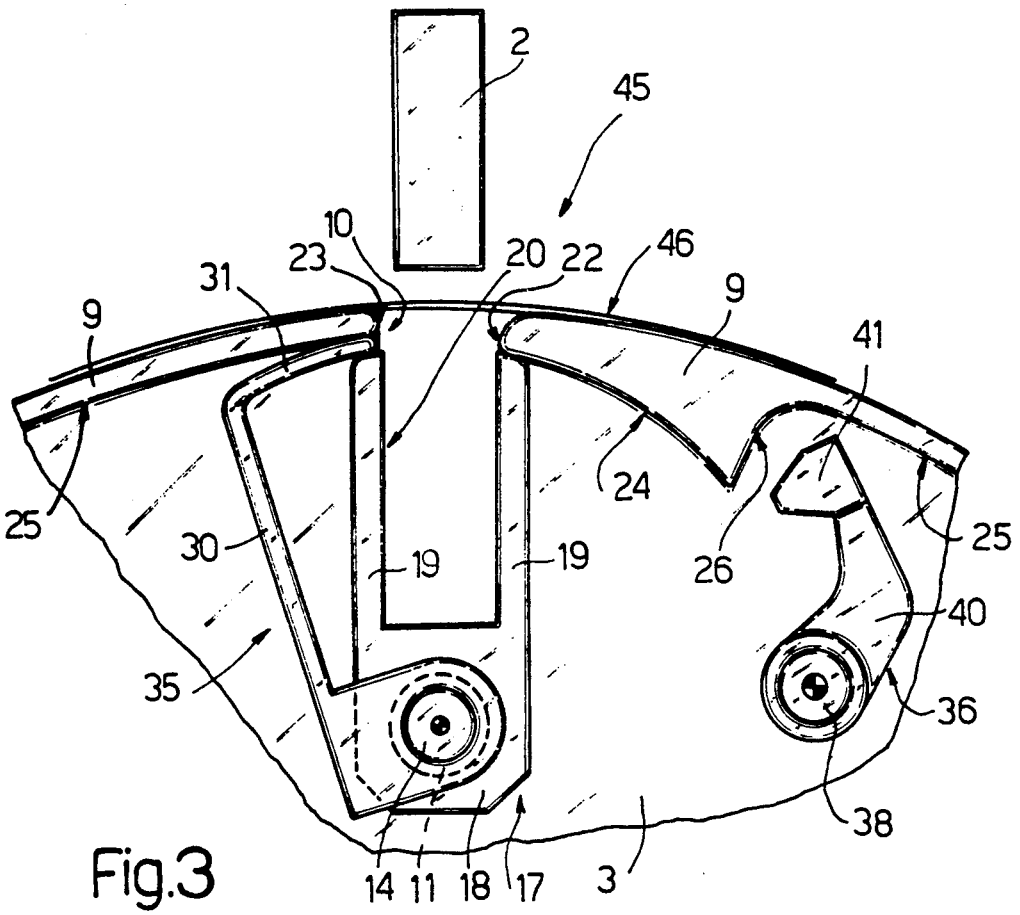

Operation of wheel 1 and, in particular, each unit 35 will now be described with reference to FIGS. 3 to 8. As shown in FIG. 3, as they are rotated by wheel 1 towards loading station 45, units 35 are fed successively with respective sheets 46 of wrapping material by a known feed device (not shown), each sheet 46 being laid across opening 10, contacting the two adjacent segments 9 on either of the same. In particular, the opposite ends of each sheet 46 are maintained contacting shell 8 in known manner by means of suction holes (not shown) formed through segments 9. Close to loading station 45, each unit 35 is arranged with the side opening of seat 20 facing opening 10, with mobile folder 31 in the idle position enabling access to seat 20 through opening 10, and with welder 41 backed up in the idle position.

Figure 4:
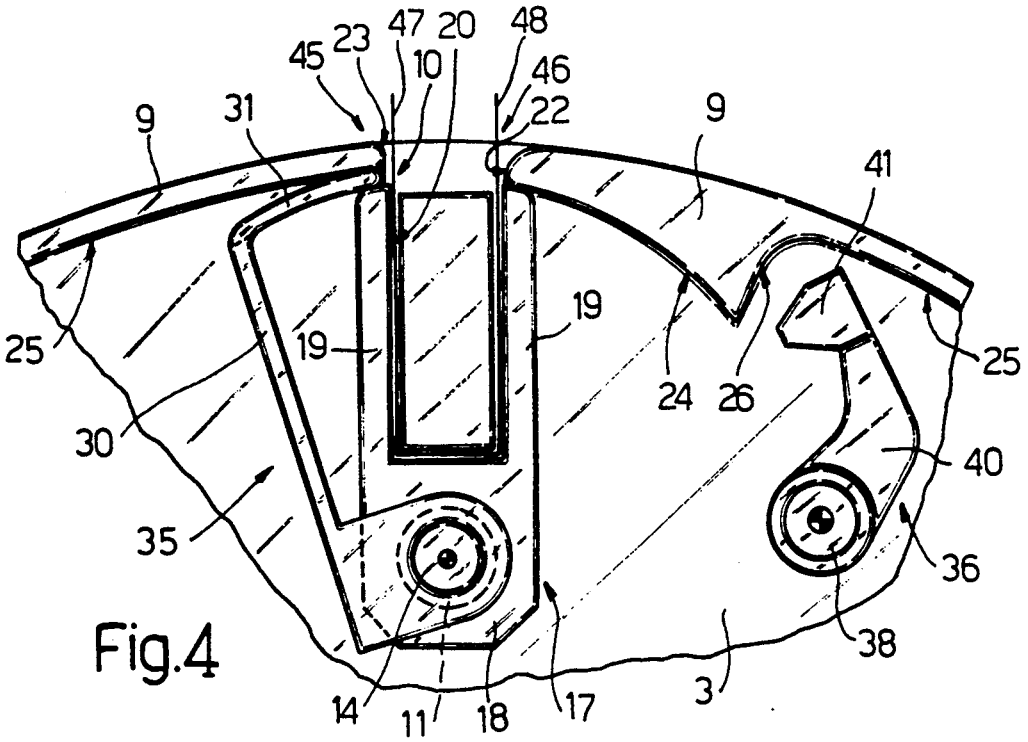
Figure 5:
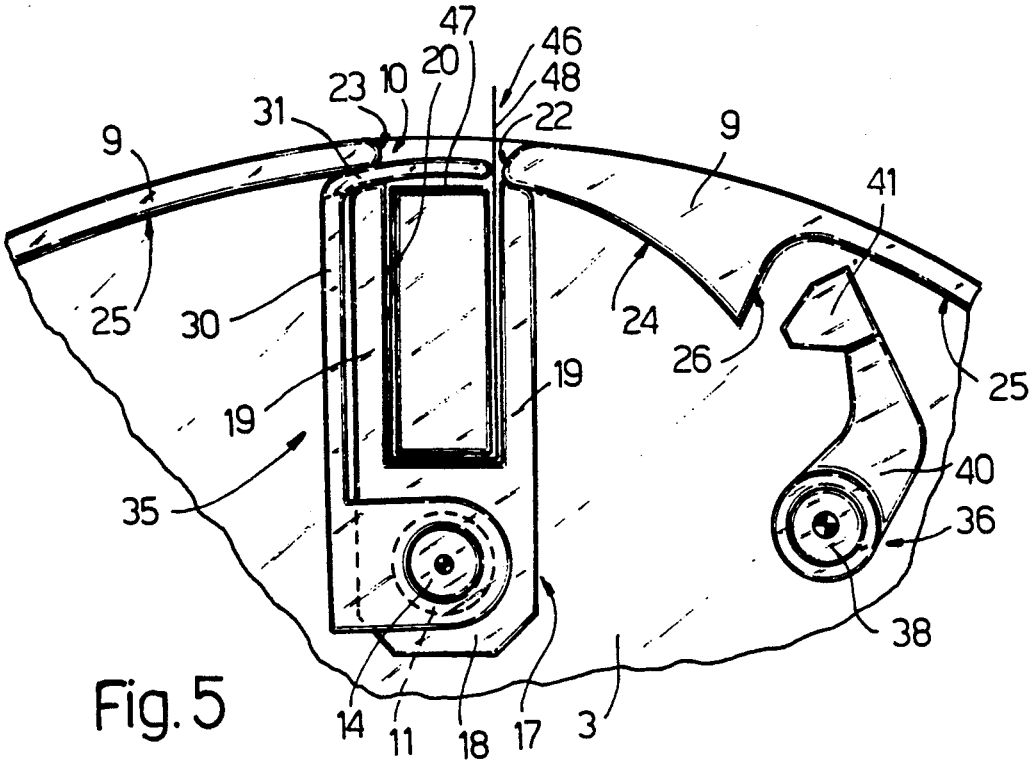
Figure 6:
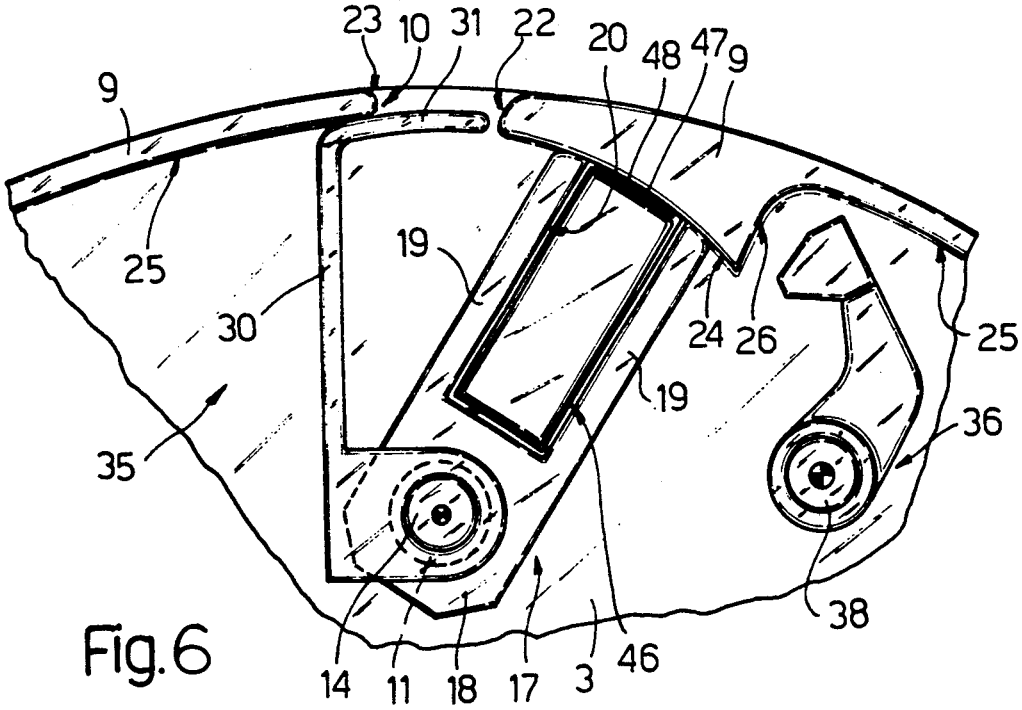

As shown in FIG. 4, upon unit 35 entering station 45, a known feeder (not shown) inserts a product 2 through opening 10 into seat 20. As it is inserted inside seat 20, product 2 gradually folds sheet 46 into a U, so that, when product 2 is fully inserted, sheet 46 is folded in a U about product 2, with two opposite lateral end portions 47 and 48 projecting outwards of seat 20 and opening 10.

As unit 35 leaves loading station 45, cam 34 rotates shaft 14 (clockwise in FIG. 5) and moves folder 31 into the operating position contacting front edge 22 of segment 9. As it moves, folder 31 engages front portion 47 of sheet 46, which it gradually folds down on to the lateral surface of product 2. Once portion 47 has been folded, cam 34 maintains folder 31 substantially in the operating position, while cam 29 rotates shaft 11 and consequently also respective seat holder element 17, which, sliding in contact with folder 31 and surface 24, moves into said second position inside shell 8, thus gradually causing portion 48 to be folded down on to portion 47 by front edge 22 of segment 9, which acts as a second folder for sheet 46.

As shown in FIG. 7, rotation of shaft 11 and seat holder element 17 (clockwise in FIG. 6) is arrested when over half of the lateral opening of seat 20 projects beyond the rear edge of surface 24, a sufficient portion of said lateral opening remaining covered by surface 24 for engaging the end portion of portion 48 and so holding this and underlying portion 47 down on product 2.

At this point (FIG. 7), cam 44 activates joining device 36, welder 41 is brought into contact with portion 48, and both portions 47 and 48 joined firmly for producing tubular wrapping 49 about product 2 (FIG. 8). Subsequent to rotation of wheel 1, cams 29, 34 and 44 then return folder 31, seat holder element 17 and welder 41 to their former positions prior to unit 35 entering the unloading station (not shown) where product 2, complete with tubular wrapping 49, is withdrawn from seat 20 (in known manner not shown) for further processing if necessary.

Tubular wrapping 49 in FIG. 8 presents an end portion 50 projecting axially beyond an axial end of product 2. Portion 50, which in some cases may be dispensed with, is subsequently folded in known manner on to the corresponding end of product 2.

From the foregoing description, it follows that continuous rotation of wheel 1 about its axis is made possible by each unit 35 moving in relation to wheel 1 and presenting a respective joining device 36, and by the fact that the operations, such as the joining of portions 47 and 48, which on known wrapping wheels are performed by arresting the same, are performed on wheel 1 by arresting each unit 35 in relation to wheel 1.

According to a variation not shown, wrapping 49 presents two opposite portions 50 which are folded on to the respective ends of product 2 for producing a closed outer wrapping. For producing such a wrapping, however, instead of substantially contacting disc 3, as shown in FIG. 2, each unit 35 must be mounted on wheel 1 a given distance from disc 3, so as to form, between disc 3 and units 35, a space enabling one of said two end portions 50 to project from seat 20.

I claim:

1. A method of producing tubular wrappings (49) for products (2) of substantially parallelepiped shape; said method comprising stages consisting in successively feeding sheets (46) of wrapping material over respective peripheral openings (10) formed on a wrapping wheel (1) and enabling access to respective seats (20) formed on said wheel (1); feeding said products (2) successively, and in a substantially radial direction, through respective said openings (10) and into respective said seats (20), insertion of each said product (2) being accompanied by simultaneous insertion of the respective said sheet (46), which is folded in a U about said product (2) inside said seat (20), with two opposite portions (47, 48) projecting outwards of said opening (10); successively folding said two portions (47, 48) about said product (2), so that a second (48) of said portions at least partially overlaps a first (47) of said portions; and stably connecting said two overlapping portions (47, 48) via joining means (36); characterised by rotating said wheel (1) at substantially constant speed about its axis, moving a seat holder element (17) on said wheel and on which element said seat carrying a product and wrapping sheet is mounted in relation to the wheel between a first position, wherein said seat (20) faces substantially radially outwards of said wheel (1), and a second position wherein said seat (20) is aligned with respective said joining means (36) supported on said wheel (1) folding said second portion (48) being folded by moving the respective said seat holder element (17) into said second position, and via interference with folding means (9) supported in a fixed position on said wheel (1) and sealing said projecting portions with said joining means on said wheel while said seat holder is in said second position.

2. A method as claimed in claim 1, characterised by the fact each seat holder element (17) is assigned mobile folding means (31) designed to move transversely in relation to said seat (20) and in front of said opening (10) to the same; said mobile folding means (31) being activated for folding said first portion (47) with said seat (20) in said radial position.

3. A method as claimed in claim 1, characterised by the fact that, to move in relation to said wheel (1) between said first and second positions, each seat holder element (17) swings about an axis parallel to the rotation axis of said wheel (1).

4. A method as claimed in claim 1, characterized by the fact that the joining means (36) assigned to each said seat holder element (17) are designed to move in relation to said wheel (1), and are moved to and from an operating position contacting said second portion (48) when said seat holder element (17) is in said second position.

5. A device for producing tubular wrappings (49) for products (2) of parallelepiped shape substantially; said device comprising a rotary wrapping wheel (1) having a number of peripheral seats (20) and a number of peripheral openings (10), each enabling access to a respective said seat (20), which is designed to receive a respective said product (2) together with a respective sheet (46) of wrapping material folded in a U about said product (2) with two opposite portions (47, 48) projecting outwards of said seat (20) through said opening (10); folding means (31, 9) for successively folding said two portions (47, 48) about said product (2), so that a second (48) of said portions at least partially overlaps a first (47) of said portions; and joining means (36) for stably connecting said two overlapping portions (47, 48); characterised by the fact that, for each said seat (20), said device comprises a joining means (36) supported on said wheel (1); a seat holder element (17) assigned to said joining means (36) and mounted in mobile manner on said wheel (1); and first activating means (29, 11) for moving each said seat holder element (17), in relation to said wheel (1), between a first position, wherein said seat (20) faces substantially radially outwards of said wheel (1), and a second position wherein said seat (20) is aligned with the respective said joining means (36); said wheel (1) turning at substantially constant speed about its axis; and said folding means (31, 9) comprising, for each said seat holder element (17), a fixed folding means (9) supported on said wheel (1) in such a position as to interfere with the path of said second portion (48) as the respective said seat holder element (17) is moved into said second position.

6. A device as claimed in claim 5, characterised by the fact that a mobile folding means (31) is mounted on said wheel (1) and assigned to each said seat holder element (17) for folding said first portion (47); second activating means (34, 14) being provided for moving each said mobile folding means (31) transversely in relation to said seat (20) in said first position, and in front of said opening (10) to said seat (20).

7. A device as claimed in claim 5, characterised by the fact that each said seat holder element (17) is mounted on said wheel (1) so as to swing between said first and second positions about an axis parallel to the rotation axis of said wheel (1).

8. A device as claimed in claim 1, characterised by the fact that each said joining means (36) is mounted on said wheel (1) so as to turn about a respective axis parallel to the rotation axis of said wheel (1); third activating means (44, 37) being provided for swinging each said joining means (36) to and from an operating position contacting said second portion (48) when the respective said seat holder element (17) is in said second position.

9. A device as claimed in claim 5, characterised by the fact that said wheel (1) presents a fixed peripheral shell (8) defined externally by a cylindrical surface (21) coaxial with the rotating axis of said wheel (1); said openings (10) being formed through said shell (8) and dividing the same into a number of segments, each assigned to a respective said seat holder element (17); each said segment constituting a said fixed folding means (9).

10. A device as claimed in claim 9, characterised by the fact that each said segment (9) of said shell (8) is partially defined internally by a curved cylindrical surface (24) coaxial with the rotation axis of a respective said seat holder element (17); said seat holder element (17) sliding substantially in contact with said curved inner surface (24) as it swings between said first and second positions; and one end of said curved surface (24) partially closing the access to said seat (20) when said seat holder element (17) is in said second position.

* * * * *